US005109140A

United States Patent [19]

Nguyen

[11] Patent Number: 5,109,140

[45] Date of Patent: Apr. 28, 1992

[54] HIGH FIDELITY AUDIO CABLE

[76] Inventor: Kha D. Nguyen, 9988 Moss Pond Dr., Boca Raton, Fla. 33496

[21] Appl. No.: 509,215

[22] Filed: Apr. 16, 1990

[51] Int. Cl.[5] ..... H01B 7/34

[52] U.S. Cl. ..... 174/36; 174/32

[58] Field of Search ..... 174/32, 34, 36, 114 R, 174/115; 178/45

[56] References Cited

U.S. PATENT DOCUMENTS 4,506,235 3/1985 Mayer ..... 174/36 X

FOREIGN PATENT DOCUMENTS 2237985 2/1974 Fed. Rep. of Germany ... 174/114 R
45010 2/1989 Japan ..... 174/36
120712 5/1989 Japan ..... 174/36
8202627 1/1984 Netherlands ..... 174/36
412034 11/1966 Switzerland ..... 174/32
172619 11/1922 United Kingdom ..... 178/45

*Primary Examiner*—Morris H. Nimmo
*Attorney, Agent, or Firm*—Alvin S. Blum

[57] ABSTRACT

A cable for the transmission of audio frequency currents with reduced distortion has at least one pair of electrical conductors insulated from one another. A ferromagnetic foil is closely (less than one half millimeter) applied to the conductors. The ferromagnetic foil couples the equal and opposite external magnetic fields generated by the signal currents. This greatly reduces distortion due to the frequency-dependent magnetic effects on signal transmission.

18 Claims, 3 Drawing Sheets

PRIOR ART

HIGH FIDELITY AUDIO CABLE

BACKGROUND OF THE INVENTION

This invention relates to electric cables and more particularly to cables for the transmission of audio frequency currents with reduced frequency-related distortion.

When electric signals in the audio range are transmitted by cable, there is always some loss in fidelity of the signal. Some loss is due to the superimposition of external electrical noise upon the signal. Various shielding structures are provided for reducing this effect. Because the human hearing apparatus is such an extraordinarily sensitive analyzer of complex audio signal patterns, very small changes in the attenuation of different frequencies or phase shift at different frequencies, and the like, are readily recognizable to the trained ear as distortion. All audio signal cables produce some distortion, even the most elaborate and expensive of the prior art.

SUMMARY OF THE INVENTION

It is accordingly an object of the invention to provide an audio signal cable that transmits audio signals with improved fidelity. It is yet another object of the invention to provide a high fidelity audio signal cable having simple construction that is economical to fabricate.

The audio signal cable of the invention comprises one or more pairs of electrical conductors insulated from one another for carrying the signal current in one direction in one member of the pair and in the opposite direction in the other member of the pair. A ferromagnetic foil is closely wrapped around the conductors. The foil must come very close to the conductors of the pair (closer than half a millimeter) in order for the foil to improve the fidelity by coupling the equal and opposite external magnetic fields as they are conducted through the foil. This action reduces the magnetic field effect of the audio currents that contribute to audio distortion, resulting in an improved fidelity of transmission. It has been found that the closer the foil can be applied to the conductors, the greater the improvement, and also the more surface in close proximity to the foil, the greater the improvement. This magnetic coupling effect is not found at frequencies above the audio range. Other layers of insulation and electromagnetic shielding against stray electrical signals may be provided outside the magnetic foil, and additional conductors such as ground wire for balanced mode may be included with the conductor pairs within the foil.

These and other features, objects and advantages of the invention will become more apparent when the detailed description is considered in conjunction with the drawings.

DETAILED DESCRIPTION OF THE PREFERRED EMBODIMENTS

The audio-signal frequence range is about 20 Hz to 20 KHz. Each frequency behaves differently when it travels through a cable. This difference in behavior is caused by frequency-dependent differences in electrical properties such as electric field, magnetic field, etc. This difference does not add any positive affect to the sound quality, only distortions. This is the main reason why cables with different constructions sound differently. The object of the invention is to develop a technique to minimize the audio-signal distortion caused by magnetic fields.

Figure 1:
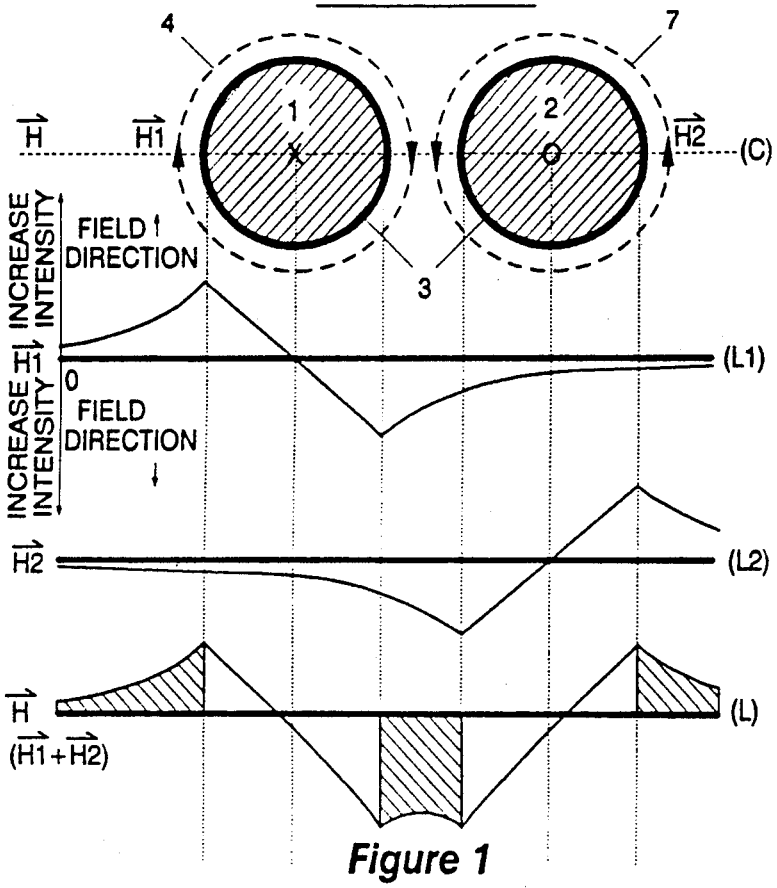
FIG. 1 is a cross sectional view of a pair of conductors carrying current and graphic representation of the magnetic fields surrounding them.

FIG. 1 shows a cross-section of a two-conductor-cable with the direction of current-flow in each conductor (x=current flows into the page, o=current flows out of the page) and the associated magnetic fields 4 and 7 resulting from those current-flows. By electrical property, the current-flow in conductor 1 is equal to current-flow in conductor 2, but opposite in direction to each other. Consequently, the magnetic field 4 of conductor 1 is equal to the magnetic field 7 of conductor 2 but opposite in direction to each other. Insulation 3 surrounds each conductor.

"H1" represents the magnetic field 4 vector of conductor 1 at any point on the dashed line (C).

"H2" represents the magnetic field 7 vector of conductor 2 at any point on the dashed line (C).

"H" represents the magnetic field vector of the cable at any point on the dashed line (C). "H" is the vector sum of "H1" and "H2".

The waveforms shown on the three thicker lines (L1,L2.L) below the cable cross-sections indicate the intensities and directions of the magnetic field of each vector "H1", "H2", and "H" at any point on the dashed line (C). When the waveform is above the thicker line it indicates that the magnetic field direction is upward, when it is below, the direction is downward. Where it crosses the line, the magnetic field is zero. The intensity of the field is indicated by its distance from the line. The shaded areas are the areas where the magnetic field exists outside the conductors.

FIG. 1 line (L) shows that the magnetic field "H" exists outside the conductors (indicated by the shaded area). If a magnetic field exists here, then we can say that some of the energy of the signal was transferred to this field and, therefore, affects the behavior of the signal. In fact, signals of different frequencies and amplitudes have different magnetic field distributions. Since audio cables of the prior art, as shown here, have different magnetic field losses at different frequencies, they distort the audio signals they transmit.

Figure 2:
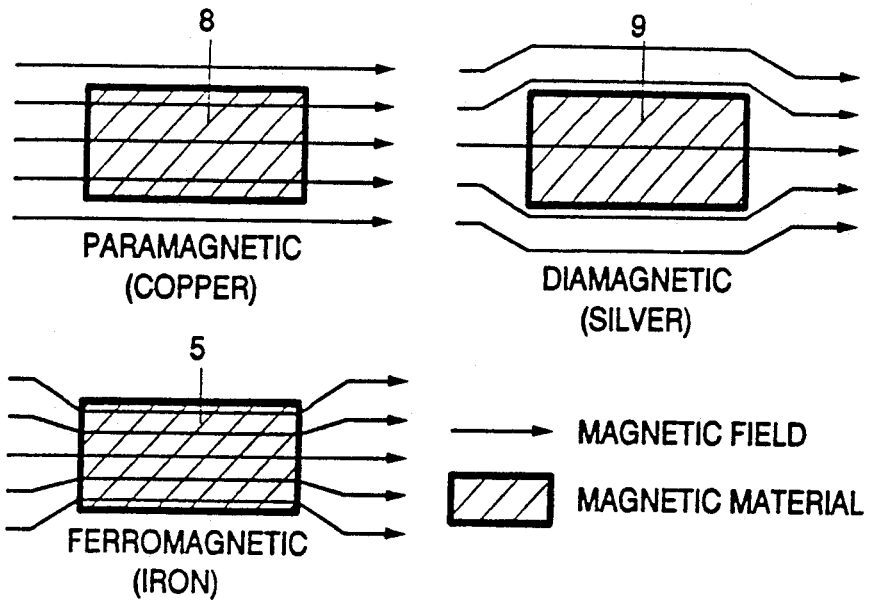
FIG. 2 illustrates diagrammatically the magnetic properties of three different materials.

There are three classifications of magnetic materials: paramagnetic 8, diamagnetic 9, and ferromagnetic 5. A paramagnetic material (such as copper) is a material which does not react with a magnetic field. A diamagnetic material (such as silver) is a material which repels a magnetic field. And a ferromagnetic material (such as iron) is a material which attracts a magnetic field. Ferromagnetic material is a very useful material in the technique which we will discuss shortly. When a magnetic field travels across ferromagnetic material, it has the tendency to travel inside the material instead of the air. The magnetic field is similar to electrical current. It will find the easiest path to flow through. The properties of these materials are shown in FIG. 2.

The following is the technique that takes advantage of ferromagnetic property to eliminate the magnetic field outside the conductors (as discussed in the previous example).

Figure 3:
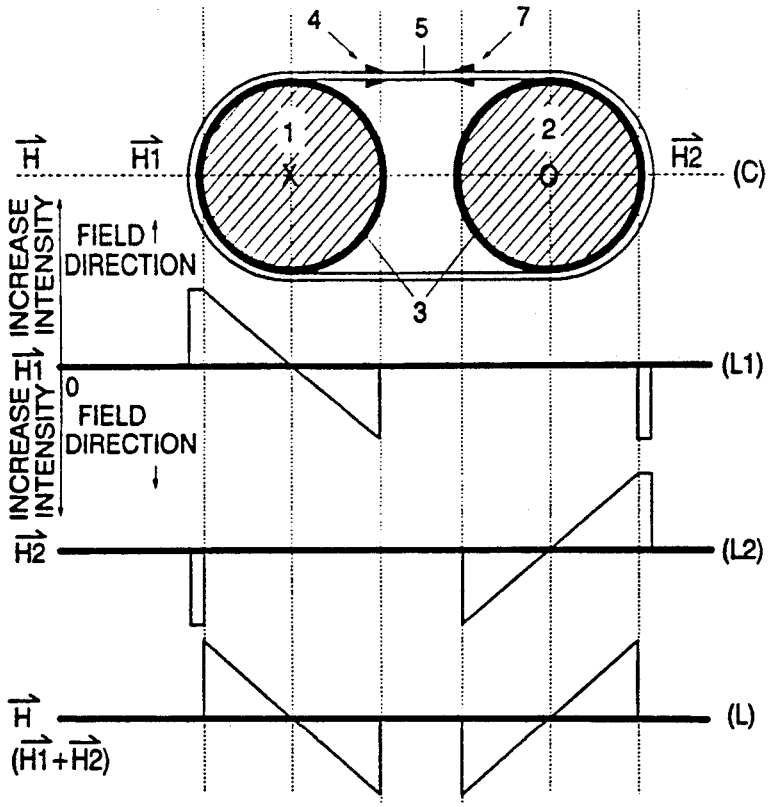
FIG. 3 is a cross sectional view of the cable of the invention and a graphic representation of the magnetic field surrounding it.

FIG. 3 shows a two-conductor-cable similar to that described in the previous example except that the conductors are covered with ferromagnetic material 5 and this ferromagnetic material is insulated from the conductors by electrical insulation having a thickness of less than one half millimeter. Note that the magnetic field distribution is changed because of the presence of the ferromagnetic material.

After covering the two conductors with the ferromagnetic material, the magnetic fields of both conductors become attracted to the ferromagnet material. Instead of radiating outside the conductors, the fields will travel inside this ferromagnetic material. This ferromagnetic material 5 provides a single continious, closed magnetic field path for both conductors. The magnetic field 4 of conductor 1 will travel clockwise in the ferromagnetic material and has the intensity equal to the magnetic field intensity at the surface of conductor 1. Likewise, the magnetic field 7 of conductor 2 will travel counter-clockwise in the same ferromagnetic material path and has the intensity equal to the magnetic field intensity at the surface of conductor 2. Since the magnetic field of each conductor is equal in intensity but opposite in direction to each other, they will cancel each other out, resulting in no magnetic field outside the conductors. See waveforms on lines (L1), (L2) and (L) of FIG. 3.

FIG. 3 line (L) shows that no magnetic field exists outside the conductors. If no magnetic field exists outside the conductors, we can then say that the audio signals do not lose their energy to this magnetic field, therefore, minimizing the distortions due to magnetic field ("minimize", rather than eliminate, since there will be some insignificant amount of energy lost due to a small amount of magnetic field "leakage" in the non-conductor area within the ferromagnetically covered area).

By using this technique, the difference in behavior due to audio frequencies themselves (caused by magnetic fields) will be minimized, and therefore, the audio signal quality of the cable will be improved. Furthermore, this technique has a greater advantage when applied to conductors that carry higher current, such as speaker cables.

This technique was actually modeled and tested in a real audio environment resulting in a sound quality improvement that was easily noticeable to the listener.

Figure 4:
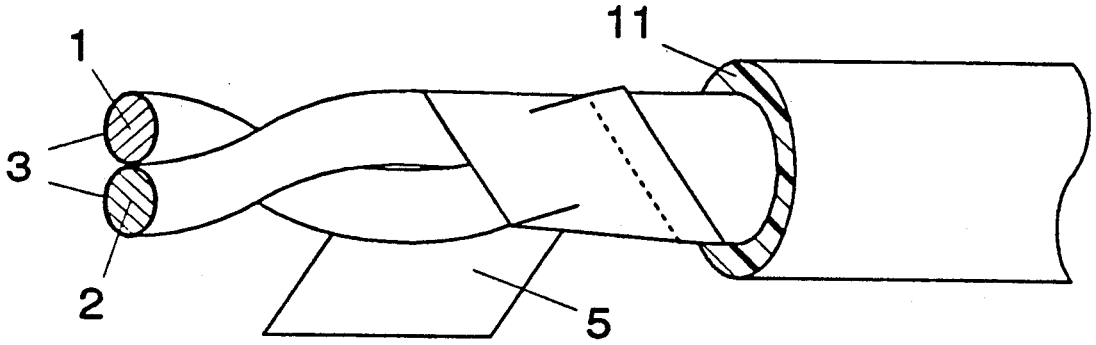
FIG. 4 is a perspective view of the cable of the invention.

FIGS. 4-7 show details of construction of cables of the invention in various forms. FIG. 4 shows two round conductors 1, 2 with insulation 3 surrounded by ferromagnetic foil 5 in tape form wound helically around the conductors, and covered by an outer insulation 11. Other means of closely wrapping the foil may be employed as desired. It has been found that sharp bends of the foil reduce its effectiveness. Spacing is exaggerated in these illustrations, but in all cases, the foil must be within one-half a millimeter from each conductor in order to be effective.

Figure 5:
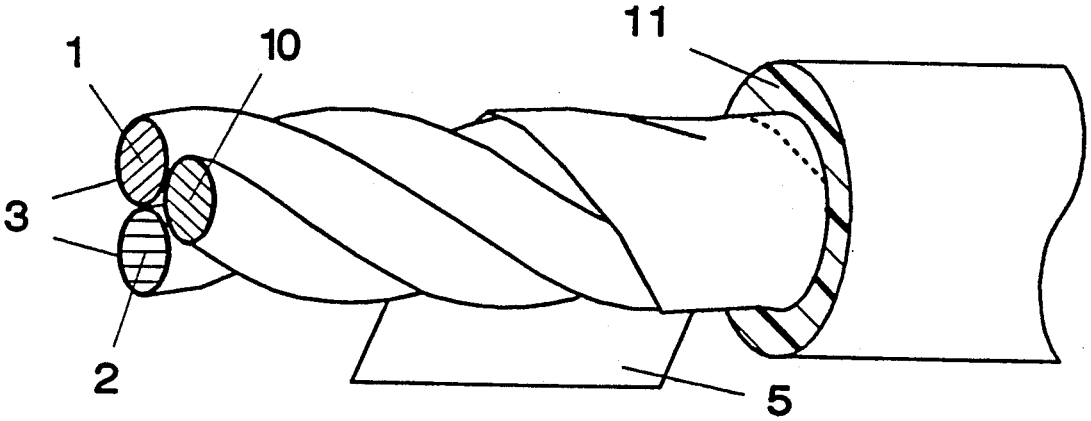
FIG. 5 is a perspective view of a cable of the invention with a ground conductor.
Figure 7:
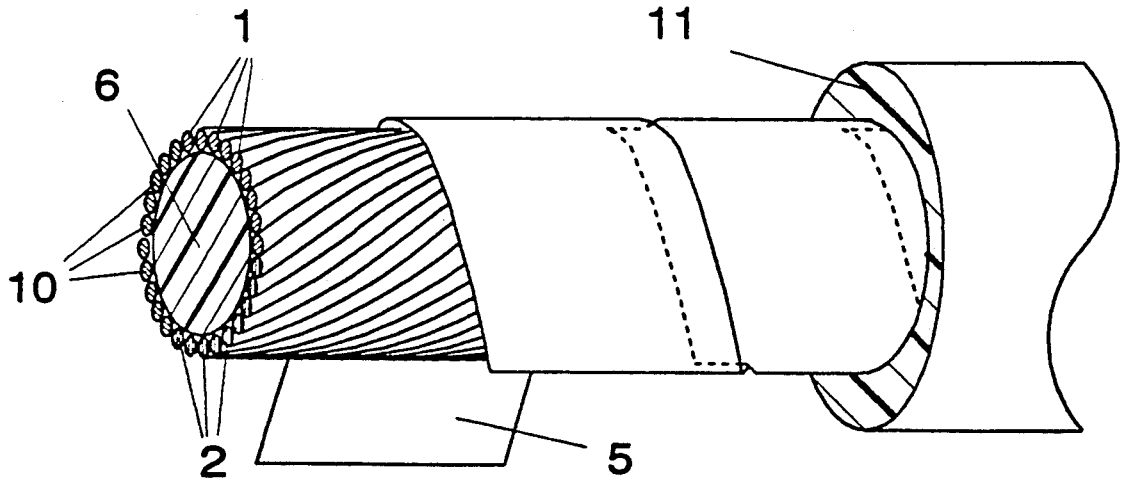
FIG. 7 is a perspective view of a cable of the invention having a pair of multistranded conductors and a ground conductor.

FIGS. 5 and 7 show balanced mode embodiments with a ground conductor 10.

In FIGS. 4 and 5 the conductors are solid.

Figure 6:
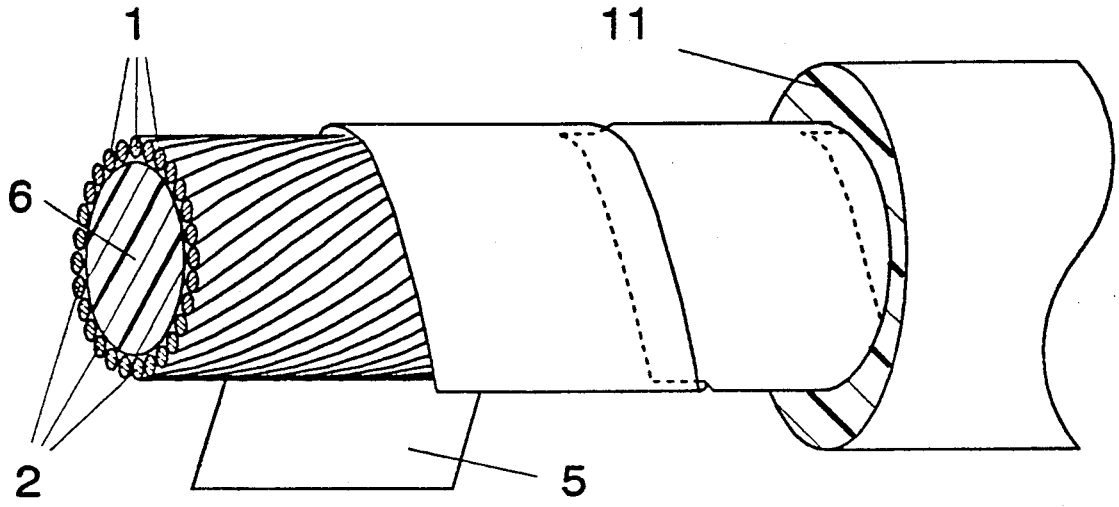
FIG. 6 is a perspective view of a cable of the invention with a pair of multistranded conductors.

In FIGS. 6 and 7, each of the conductors is multistranded and arranged about a central dielectric 6 such that more of each conductor is in close proximity to the foil 5. Each individual strand may be insulated and the foil is covered by insulation 11.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A cable for the flow of audio frequency electrical currents with reduced distortion when in use, said currents generating magnetic fields, said cable comprising:

a plurality of elongate electrical conductors electrically insulated from one another: a ferromagnetic foil means magnetically enclosing said conductors in a substantially symmetrical and continuous layer, said foil means spaced apart from each of said conductors by a distance that is less than five-tenths of a millimeter at its closest point, wherein said foil means couples together magnetic fields generated about each of said conductors by said electrical currents, wherein said currents flow in opposite directions with a net current flow of substantially zero and said magnetic fields pass through said layer in substantially equal and opposite continuous closed paths so that the effect of said foil on said magnetic fields is substantially equal and opposite, whereby the distorting effects of magnetic field variation with frequency are reduced.

2. The cable according to claim 1 in which all of said conductors are symmetrically arranged with relation to said ferromagnetic foil means.

3. The cable according to claim 2 in which said foil means is electrically insulated from said conductors.

4. The cable according to claim 3 in which said ferromagnetic foil means is helically wound about said conductors.

5. A cable for the transmission of audio frequency electrical currents with reduced distortion when in use, said currents generating magnetic fields, said cable comprising:

a) at least one pair of electrical conductors insulated from one another and arranged for carrying a common audio frequence current in opposite directions;

b) a ferromagnetic foil encircling said electrical conductors and located at the closest point within a distance of five-tenths of a millimeter of each said conductor;

c) each member of at least one pair of said conductors being positioned substantially in the same orientation relative to said foil, said foil forming a substantially continuously encircling, closed path for magnetic fields in which said path for magnetic fields generated by electric currents in a first member of said pair is substantially the same closed path as said path for magnetic fields generated by electrical currents in a second member of said pair and the direction is opposite, so that the effect of said foil on magnetic fields generated by said current is substantially equal and opposite, whereby the distorting effects of magnetic field variation with frequency are reduced.

6. The cable according to claim 5 in which said foil is electrically insulated from said conductors.

7. The cable according to claim 5 in which said foil is helically wound about said conductors.

8. The cable according to claim 5 in which said foil also encloses at least one ground conductor.

9. The cable according to claim 5 in which said ground conductor is symmetrically arranged with relation to the audio frequency current conductors.

10. The cable according to claim 5 in which said conductors are multistranded.

11. The cable according to claim 8 in which said conductors are multistranded.

12. A cable for transmission of audio frequency electrical currents with reduced distortion, said cable comprising:

a) at least one pair of elongate electrical conductors insulated from one another and arranged for carrying a common audio frequency current of equal amplitude and opposite directions;

b) a ferromagnetic foil means for magnetically enclosing said at least one conductor pair, said foil means helically wound about all said conductors and spaced apart from each of said conductors by electrical insulation thickness that is less than five-tenth of a millimeter at its closest point, said foil forming a substantially continuously encircling closed path for magnetic fields in which said path for magnetic fields generated by electric currents in a first member of said pair is substantially the same as said path for magnetic fields generated by electric currents in a second member of said pair and the direction is opposite, wherein said foil means couples together the magnetic field generated about each of said conductors by said electrical currents to reduce distortion from magnetic field losses.

13. A cable according to claim 12 in which all of said conductors are symmetrically arranged with relation to said ferromagnetic foil means.

14. A cable according to claim 12 in which said conductors are multistranded conductors.

15. The cable according to claim 14 in which each of said multistranded conductors is comprised of individual adjacent strands that are electrically insulated from one another and are spread around a dielectric core in substantially a single layer to provide enhanced proximity to said foil means.

16. The cable according to claim 13 in which at least one ground conductor is also enclosed within said foil means.

17. The cable according to claim 12 in which at least one ground conductor is also enclosed within said foil means.

18. The cable according to claim 17 in which said conductors are multistranded conductors comprised of individual adjacent strands that are electrically insulated from one another and are spread around a dielectric core in substantially a single layer to provide enhanced proximity to said foil means.

* * * * *